US008408477B2

(12) United States Patent
Bösterling

(10) Patent No.: US 8,408,477 B2
(45) Date of Patent: Apr. 2, 2013

(54) SYSTEM FOR FASTENING A RAIL, AND TENSIONING CLAMP FOR A SYSTEM OF THIS TYPE

(75) Inventor: Winfried Bösterling, Neuenrade (DE)

(73) Assignee: Vossloh-Werke GmbH, Werdohl (DE)

( * ) Notice: Subject to any disclaimer, the term of this patent is extended or adjusted under 35 U.S.C. 154(b) by 220 days.

(21) Appl. No.: 12/680,373

(22) PCT Filed: Sep. 26, 2008

(86) PCT No.: PCT/EP2008/062961

§ 371 (c)(1),
(2), (4) Date: Mar. 26, 2010

(87) PCT Pub. No.: WO2009/043822

PCT Pub. Date: Apr. 9, 2009

(65) Prior Publication Data

US 2010/0308123 A1 Dec. 9, 2010

(30) Foreign Application Priority Data

Sep. 27, 2007 (DE) ..... 10 2007 046 543

(51) Int. Cl.
*E01B 9/62* (2006.01)

(52) U.S. Cl. ..... 238/349; 238/351

(58) Field of Classification Search ..... 238/349, 238/351, 352, 355, 338, 310
See application file for complete search history.

(56) References Cited

U.S. PATENT DOCUMENTS

| | | | | |
|---|---|---|---|---|
| 3,690,551 | A * | 9/1972 | Munch et al. | 238/349 |
| 4,442,973 | A | 4/1984 | Fee | |
| 4,844,337 | A | 7/1989 | Fee | |

FOREIGN PATENT DOCUMENTS

| | | | |
|---|---|---|---|
| CN | 101360864 | A | 2/2009 |
| DE | 3147387 | A1 | 6/1983 |
| DE | 202004020752 | U1 | 12/2005 |
| EP | 0794290 | A1 | 9/1997 |
| WO | 2007082553 | A1 | 7/2007 |

* cited by examiner

*Primary Examiner* — Mark Le
(74) *Attorney, Agent, or Firm* — The Webb Law Firm

(57) ABSTRACT

A system for fastening a rail having a rail foot, a web positioned thereon, and a rail head, includes a tensioning clamp with a carrying plate. The carrying plate has a central portion for bracing the tensioning clamp on the carrying plate, at least one torsion portion branching off from the central portion in the lateral direction and a holding arm connected to the torsion portion via a curved transition portion. The holding arm extends, starting from the transition portion, counter to the torsion portion and exerts via the free end of its end portion a resilient holding-down force on the rail foot of the rail to be fastened. The length of the torsion portion and the course of the transition portion is adapted to each other in such a way that at least the transition portion is guided without supports laterally past a region of the carrying plate that is associated with the central portion of the tensioning clamp. The end portion of the holding arm is angled away from the torsion portion in such a way that it points in the direction of the web of the rail to be fastened.

11 Claims, 3 Drawing Sheets

SYSTEM FOR FASTENING A RAIL, AND TENSIONING CLAMP FOR A SYSTEM OF THIS TYPE

BACKGROUND OF THE INVENTION

1. Field of the Invention

The invention relates to a system for fastening a rail which has a rail foot, a web positioned thereon and a rail head. The system according to the invention comprises in this case a carrying plate and a tensioning clamp held on the carrying plate. This tensioning clamp has a central portion for bracing the tensioning clamp on the carrying plate, at least one torsion portion branching off from the central portion in the lateral direction and a holding arm which is connected to the torsion portion via a curved transition portion, extends, starting from the transition portion, counter to the torsion portion and exerts via the free end of its end portion a resilient holding-down force on the rail foot of the rail to be fastened. In this case, the length of the torsion portion and the course of the transition portion are adapted to each other in such a way that at least the transition portion is guided without supports laterally past a region of the carrying plate that is associated with the central portion of the tensioning clamp.

2. Background of Related Art

A fastening system of this type is offered by the Applicant under the name "System KS with SKL 24", "SKL 24" denoting the specific type of tensioning clamp used in the known system.

In the known system, configured on the carrying plate are two ribs which extend over the length of said carrying plate measured in the longitudinal direction of the rail to be mounted and delimit between them a portion in which, when the system is fully assembled, the foot of the rail which is then fastened is positioned. The ribs serve on the one hand as lateral stops which delimit transverse movements of the rail that occur when a rail vehicle passes over it. On the other hand, the ribs are used in the known system for fastening the tensioning clamp via which the holding force required for holding down the rail is applied resiliently to the rail foot.

In accordance with the basic principle known from DE 20 2004 020 752 U1, the ω-shaped "SKL 24" tensioning clamp used in the known system is configured in such a way that its torsion portions and holding arms have a maximum spring deflexion and, in conjunction therewith, maximum resilience. For this purpose, the known tensioning clamp has a looped central portion, from the ends of which a respective torsion portion, which is substantially straight in its configuration, issues in the direction of the respective side. The torsion portions then each merge with a transition portion which is curved back, viewed from above, through 180° in the direction of the central portion and is in turn adjoined by a respective holding arm which is straight in its configuration and runs substantially parallel to the torsion portion associated with the respective side. The clear width between the torsion portions and the holding arm respectively associated with them is in this case, viewed from above, substantially constant and corresponds in this case to the thickness, measured transversely to the longitudinal extension of the rail to be fastened, of the rib plus an excess which is required to receive the rib, in the thickness direction thereof, with play into the space surrounded by the torsion portions and holding arms.

In the known system, the holding arms of the tensioning clamps exert, as in all fastening systems equipped with tensioning clamps of this type, in the fully assembled state the required holding forces on the rail via the free end of the end portions of said holding arms.

The tensioning clamp is braced on the carrying plate in the known system via a nut screwed onto a tensioning bolt. The tensioning bolt is positioned at one end in a recess formed centrally in the upper side of the respective rib and is guided at its other end through the opening bounded by the central portion.

In practical use, the "System KS with SKL 24" described hereinbefore has fulfilled the expectations placed on this system. However, it occurred that the holding arms were positioned with their free ends on the rail foot with such imprecision that, under the loading, which occurs in practice, of the rail and fastening system, there was a risk of sliding-off from the rail foot.

In addition, the assembly of the known system has proven problematic. Thus, it can occur, in particular in the case of automatic assembly under the rough conditions prevailing on site, that the tensioning clamp rotated under the action of the assembly and tensioning forces and automatically left the position on the rib required for optimum functioning thereof.

SUMMARY OF THE INVENTION

Against the background of the prior art described hereinbefore, the invention was based on the problem of providing a system for fastening a rail, which system can be assembled more easily, while maintaining the spring behaviour of the known fastening system, and has overall improved operational safety. In addition, a tensioning clamp which is particularly suitable for this purpose is to be disclosed.

With regard to the system, this problem has been solved in accordance with the invention by the fastening system disclosed herein. Advantageous configurations of the system according to the invention are also disclosed.

With respect to the tensioning clamp, the solution according to the invention to the above-mentioned problem consists in the fact that a tensioning clamp of this type is configured in accordance with an embodiment described herein. Advantageous configurations of the tensioning clamp according to the invention are also disclosed.

A system according to the invention uses, as in the prior art, as a spring element for generating the resilient holding force required to hold down the rail a tensioning clamp which is configured, in view of the length, measured in the longitudinal direction of the rail to be fastened, of the carrier plate, in such a way that its at least one holding arm can cover maximum spring deflexions. In contrast to the prior art, the end portion of the holding arm is in this case angled so as to point away from the torsion portion in such a way that it points, in the assembly position, in the direction of the web of the rail to be fastened.

As a result of this measure, on the one hand, the support region, in which the holding arm exerts with its end portion the required holding-down force on the rail foot, is displaced from the edge of the rail foot in the direction of the rail web. This ensures that the required holding force is optimally transferred in all cases from the respective holding arm to the rail foot even when the rail foot moves to an excessive degree, transversely to the longitudinal direction thereof, as a result of the transverse forces occurring when the rail is traveled over and of lateral supporting, which may be imprecise, on the carrying plate.

On the other hand, the configuration according to the invention of the tensioning clamp used in a system according to the invention reduces the tendency to rotate during assembly. Thus, the displacement, which is carried out in accordance with the invention, of the support region in the direction of the rail web causes, despite the orientation, which more-over still runs tightly against the ribs, of the torsion portion and holding arm, higher resistance to rotation than was the case in the known embodiment with its holding arms running exclusively straight.

A further advantage of the invention consists in the fact that a tensioning clamp according to the invention can be configured, in view of the dimensions of the further components pertaining to a system according to the invention, in such a way that a further component, such as for example an insulating element for suppressing electrical bridges between the rail and fastening system, can be arranged between the rail foot and/or rib.

As a result, the invention thus provides with surprisingly simple means a fastening system in which both assembly safety and operational safety are significantly increased over the prior art.

According to a configuration of the invention that is advantageous particularly from the point of view of production, the end portion of the holding arm is angled relative to the portion of the holding arm that adjoins it in such a way that the notional extension of the end portion encloses, in the assembly position, an angle of less than 90° with the web of the rail. End portions shaped in this way can be produced particularly economically using conventional bending methods on machines which are available in practice.

Protection from rotation of the tensioning clamp mounted in a system according to the invention can additionally be increased in that, viewed from above, a partial piece of the holding arm that issues from the transition portion is oriented in the direction of the torsion portion. The reversal region, in which the respective partial piece, which is directed first in the direction of the torsion portion, then merges with the end portion of the holding arm that points away from the torsion portion, can be used to support the tensioning clamp on a correspondingly configured shaped element of the carrying plate.

This shaped element can for example be a rib which is configured on the upper side, associated with the tensioning clamp, of the carrying plate and on which the central portion of the tensioning clamp is supported. The tensioning clamp can be braced against this rib in a manner known per se. If, then, the smallest clear width between the torsion portion and the holding arm is at least equal to the thickness of the rib, the tensioning clamp can on the one hand easily be attached to the carrying plate and in this case receive the rib within it. On the other hand, the rib can be used just as easily to secure the position of the tensioning clamp. For this purpose, the dimensions of the clear width between the torsion portion and the transition point, at which, viewed from above, the partial piece of the holding arm that is directed in the direction of the torsion portion merges with the angled end portion of said holding arm, can be such that the holding arm is supported, in the assembly position, in the region of the transition point at the face of the rib that is associated with the rail to be fastened.

The resilient properties of the tensioning clamp integrated in a system according to the invention can also be supported in that, in the assembly position, the torsion portion runs parallel to the rib, without resting against said rib. In this configuration, no contact with another component impedes the free movability of the torsion portion.

In a system according to the invention too, the tensioning clamp can be ω-shaped in its configuration, in that the central portion is shaped in a looped manner and there issue therefrom two torsion portions which are oriented counter to each other and to which a respective holding arm having an angled end portion is connected via a respective transition portion.

A tensioning clamp which is configured in accordance with the invention and intended for fastening a rail has, in accordance with the prior art, a central portion, at least one torsion portion issuing from the central portion in the lateral direction, at least one transition portion adjoining the torsion portion and at least one holding arm which is connected to the transition portion and is oriented, viewed from above, counter to the torsion portion. According to the invention, the end portion of the holding arm that is associated with the free end of the holding arm is in this case angled, viewed from above, so as to point away from the torsion portion.

For the reasons set out above, it is in this case beneficial from the point of view of production if the end portion encloses an obtuse angle with a partial piece of the holding arm that adjoins it.

BRIEF DESCRIPTION OF THE DRAWINGS

The invention will be described hereinafter in greater detail with reference to drawings which illustrate an exemplary embodiment and in which.

DETAILED DESCRIPTION OF THE PREFERRED EMBODIMENTS

Figure 1:
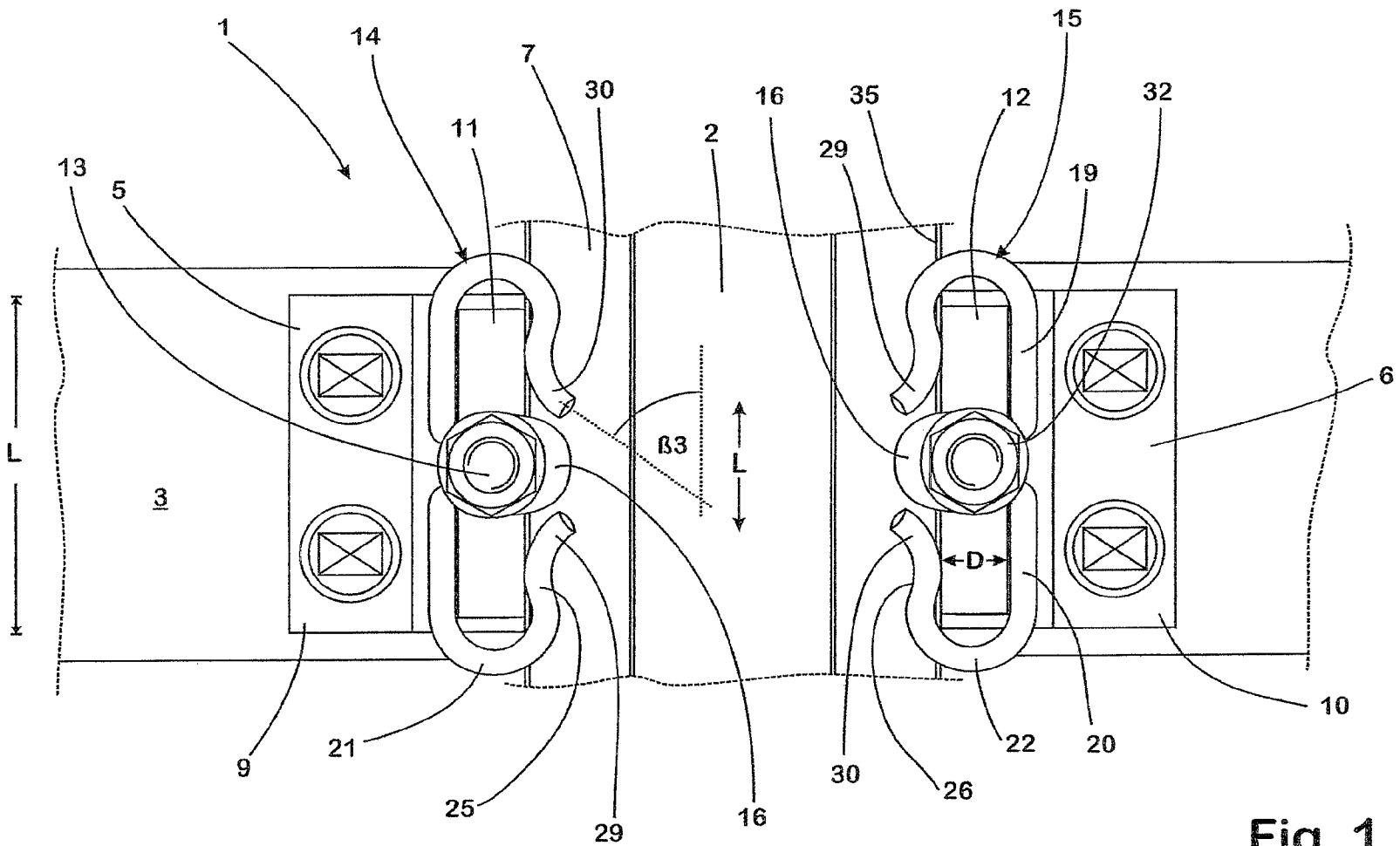
FIG. 1 is a schematic plan view of a system for fastening a rail.
Figure 2:
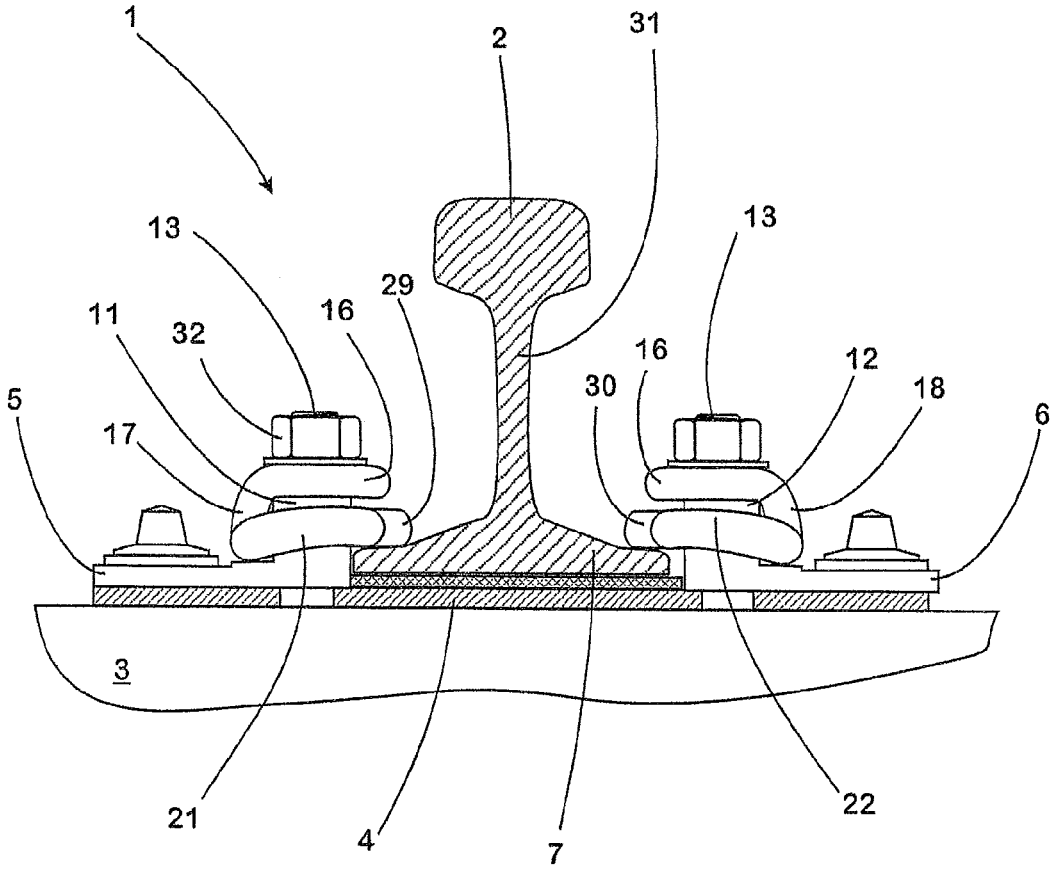
FIG. 2 is a schematic, lateral, partly cut-away view of the system for fastening a rail.
Figure 3:
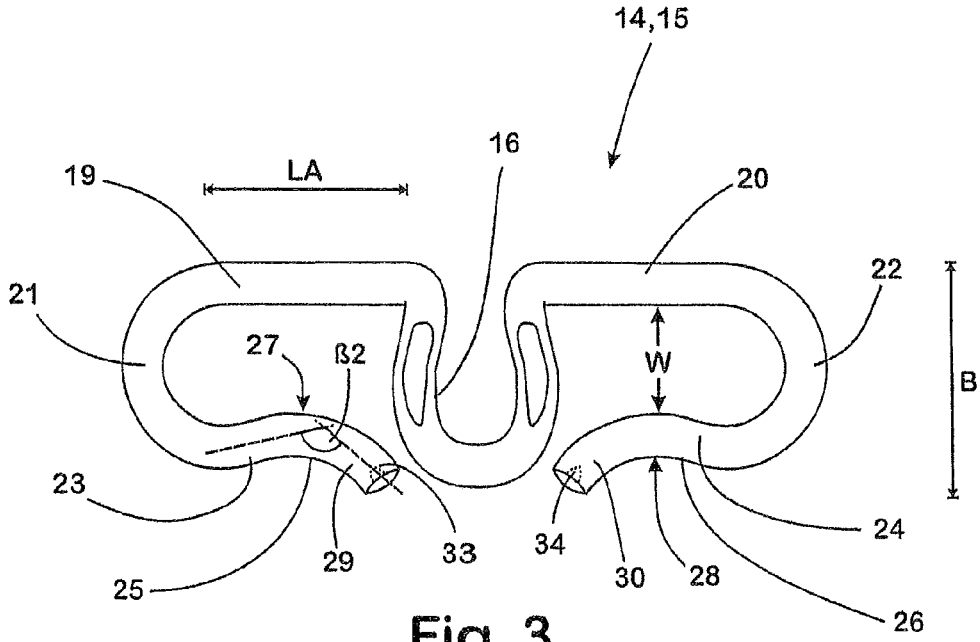
FIG. 3 is a schematic plan view of a tensioning clamp used in the system shown in FIGS. 1 and 2.
Figure 4:
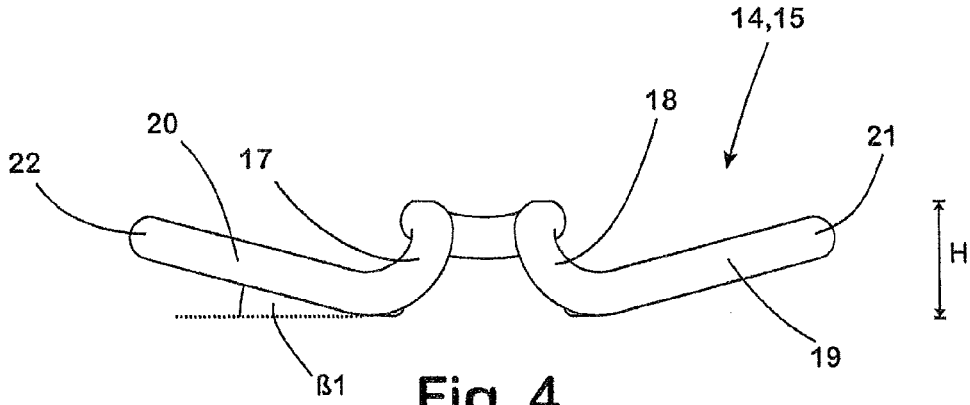
FIG. 4 is a schematic rear view of the tensioning clamp according to FIG. 3.
Figure 5:
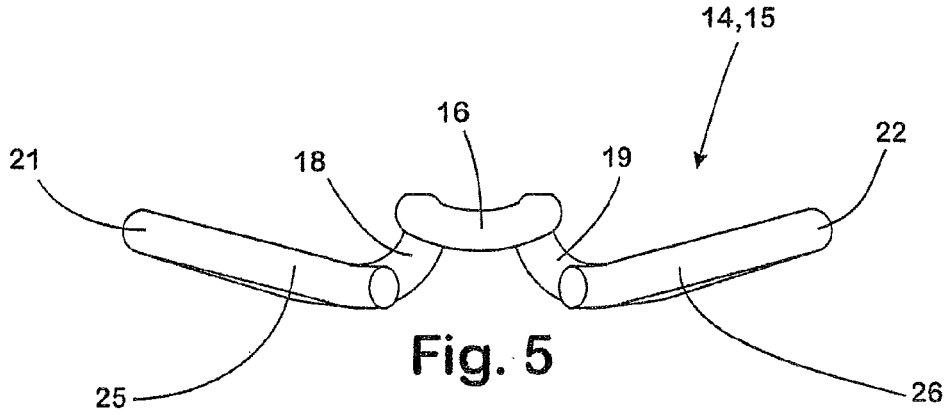
FIG. 5 is a schematic front view of the tensioning clamp according to FIG. 3.

The system 1 serves to fasten a rail 2 which is part of a track body (not illustrated in greater detail). The rail fastening system 1 has two respective identically shaped carrying plates 5, 6 which are arranged above a base plate 4 on a sleeper, a plate or another substrate 3 suitable for carrying the track body and are referred to by specialists also as "rib plates". The carrying plates 5, 6 are arranged resting in opposition against the foot 7 of the rail 2 and screwed to the substrate 3 in a manner known per se by means of screws. In order to support the rail 2 on the base plate 4 with defined flexibility in the vertical direction, a resilient layer is provided between the rail foot 7 and the base plate 4 in a manner known per se.

The carrying plates 5, 6 have, viewed from above, a respective rectangular basic shape having a length LT measured parallel to the longitudinal axis L of the rail 2. In the region adjoining the narrow side 8 which is remote from the rail 2, its upper side is configured in each case in a planar manner in the form of a plane 9, 10 descending in the direction of the narrow side 8.

Also configured on the carrying plates 5, 6, in the region of their upper side 9 that adjoins the rail foot 7, is a respective rib 11, 12 which adjoins the narrow side 14, which opposes the narrow side 8 and is associated with the rail 2, of the respective carrying plate 5, 6 and extends over the entire length LT of the respective carrying plates 5, 6.

These ribs 11, 12 ensure that the carrying plates 6, 7 laterally guide the rail 2 even when the loads which occur when a train travels over the rail 2 lead to vertically oriented lift-off movements and transverse movements directed transversely to the longitudinal direction L of the rail 2.

Finally, a fastening opening (not shown in the present document), which is configured in a manner known per se as a mushroom head milling, is formed in the carrying plate 5, 6 at a central point. A tensioning screw 13, which is configured as a hooked screw, is introduced into this fastening opening in such a way that it is held with its screw head in the fastening opening and its threaded portion protrudes beyond the upper side of the rib 11, 12.

Tensioning clamps 14, 15, each of which is associated with one of the carrying plates 5, 6, are provided for holding down the rail 2.

The tensioning clamps 14, 15 are each ω-shaped in their configuration. They have a looped central portion 16 which, viewed per se from above, is U-shaped in its configuration and surrounds, in the assembly position, the threaded portion, which protrudes beyond the respective rib 11, 12, of the tensioning screw 13 over at least 180°. The base of the central portion 16 is in this case associated with the rail 2, whereas its opening points away from the rail 2 in the assembly position.

The legs, which lead in a straight line away from the base which is, viewed from above, in the shape of a semicircle, of the central portion 16 merge in each case first in a downwardly running curved piece 17, 18 with a torsion portion 19, 20. The torsion portions 19, 20 are in this case smoothly connected to the respective curved piece 17, 18 in such a way that they are on the one hand arranged, viewed from above, at right angles to the respective legs of the central portion 16 and extend, in the assembly position, substantially parallel to the rail 2. At the same time, they point, when tensioning clamps 14, 15 rest on a plane, obliquely upward at an angle β1, so that they are supported, in the assembly position, on the respective carrying plate 5, 6 merely in the region of reversal of the respective curved piece 17, 18. The length LA of the torsion portions 19, 20 is adapted to the length L of the respective ribs 11, 12 of the carrying plates 5, 6 in such a way that their end remote from the central portion 16 protrudes laterally beyond the respective rib 11, 12.

The torsion portions 19, 20 are adjoined by a respective transition portion 21, 22 which is curved, viewed from above, through more than 180° in the direction of the base of the central portion 16. The radius of curvature of the transition portions 21, 22 is in this regard in each case larger than the thickness D of the respective rib 11, 12.

A first partial piece 23, 24 of a respective holding arm 25, 26 is formed integrally with the transition portions 21, 22. The partial pieces 23, 24 run, starting from the respective transition portion 21, 22, first, viewed from above, in the direction of the torsion portions 19, 20 arranged on the other longitudinal side of the tensioning clamps 14, 15. At the same time, the holding arms 25, 26 are as a whole oriented downward at the same angle β1 as the torsion portions 19, 20.

The partial pieces 23, 24 of the holding arms 25, 26 each merge smoothly at a curved transition point 27, 28 with a respective end portion 29, 30 of the respective holding arm 25, 26. The curvature of the transition point 27, 28 is in this case selected in such a way that the end portions 29, 30 are directed so as to point away from the torsion portions 19, 20 in the direction of the web 31 of the rail 2 to be fastened. The angle β2 enclosed, viewed from above, between the partial pieces 23, 24 and the end portions 29, 30 associated respectively therewith of the holding arms 25, 26 corresponds in this case to approximately 120°. At the same time, the clear width W at the narrowest point between the transition points 27, 28 and the respectively opposing torsion portion 19, 20 corresponds, apart from a slight excess, to the thickness D of the respective rib 11, 12.

For fastening the respective tensioning clamp 14, 15 to the rib 11, 12 respectively associated therewith, the central portion 16 is placed on the respective tensioning screw 13 in such a way that the tensioning screw 13 is guided through the opening surrounded by the central portion 16. Subsequently, a nut 32, which presses the central portion 16 against the respective rib 11, 12 and thus braces the respective tensioning clamp 14, 15, is screwed onto the tensioning screw 13.

The torsion portions 19, 20 are now arranged on the side of the respective rib 11, 12 that is remote from the rail 2 and the holding arms 25, 26 are now arranged on the side of said respective rib that faces the rail 2. In this case, the dimensions of the height H of the curved pieces 17, 18 of the tensioning clamps 14, 15 are such that the tensioning clamps 14, 15 are each supported on the respective carrying plate 5, 6 merely in the region of transition from the curved pieces 17, 18 to the torsion portions 19, 20. As, at the same time, the transition portions 21, 22 are guided around the narrow sides of the ribs 11, 12 at a distance, the tensioning clamps 11, 12 can move in a substantially freely resilient manner over their torsion portions 19, 20 and transition portions 21, 22 up to the bearing region 32, 33 of the end portions 29, 30 of the holding arms 25, 26.

When the respective tensioning clamp 14, 15 is placed onto the rib 11, 12 associated therewith, the holding arms 25, 26 rest at their respective transition point 27, 28 loosely against the end face of the respective rib 11, 12 that is associated with the rail 2. If, during the course of the screwing-on of the nut 32, the torques introduced via the nut 32 cause the tensioning clamps 14, 15 to rotate, the holding arms 25, 26 are supported at their respective transition point 27, 28 against the rib 11, 12 and thus prevent excessive deformation which might lead to defective functioning of the tensioning clamp 14, 15.

In the assembly position, the end portions 29, 30 of the holding arms 25, 26 are angled in such a way that their notional extension encloses, in the assembly position, an angle β3 of approx. 50° with the web 31 of the rail 2.

The end portions 29, 30 of the holding arms 25, 26 rest in this case offset with their bearing regions 33, 34 in the direction of the web 31 of the rail 2 relative to the edge 35 of the rail foot 7, on the upper side thereof, and thus also counteract excessive deformation of the respective tensioning clamp 14, 15 during mounting thereof. At the same time, the bearing position, which is offset in the direction of the rail web 31, of the end portions 29, 30 ensures that, despite the minimised width B of the tensioning clamps 14, 15, the required holding-down forces can be reliably transmitted at all times, even in the event of transverse movements of the rail 2.

The invention claimed is:

1. A system for fastening a rail which has a rail foot, a web positioned thereon, a rail head and a carrying plate, the system comprising a tensioning clamp held on the carrying plate, the tensioning clamp having a central portion for bracing the tensioning clamp on the carrying plate, at least one torsion portion branching off from the central portion in a lateral direction, and a holding arm which is connected to the torsion portion via a curved transition portion, the holding arm extends, starting from the transition portion, counter to the torsion portion and exerts, via a free end of its end portion, a resilient holding-down force on the rail foot of the rail to be fastened, the length of the torsion portion and the course of the transition portion being adapted to each other in such a way that at least the transition portion is guided without supports laterally past a region of the carrying plate that is associated with the central portion of the tensioning clamp, wherein the end portion of the holding arm is angled so as to point away from the torsion portion in such a way that it points, in an assembly position, in a direction of the web of the rail to be fastened.

2. The system according to claim 1, wherein the end portion of the holding arm is angled in such a way that a notional extension of the end portion encloses, in the assembly position, an angle of less than 90° with the web of the rail.

3. The system according to claim 1, wherein, viewed from above, a partial piece of the holding arm that issues from the transition portion is oriented in the direction of the torsion portion.

4. The system according to claim 1, further comprising a rib, wherein the carrying plate carries on its upper side associated with the tensioning clamp the rib on which the central portion of the tensioning clamp is supported.

5. The system according to claim 4, wherein the tensioning clamp is braced on the carrying plate by means of a tensioning means fastened to the rib.

6. The system according to claim 4, wherein the smallest clear width between the torsion portion and the holding arm is at least equal to a thickness of the rib.

7. The system according to claim 6, wherein the angled end portion of the holding arm is formed integrally with a partial piece of the holding arm oriented in the direction of the torsion portion.

8. The system according to claim 7, wherein dimensions of a clear width between the torsion portion and the transition point, at which, viewed from above, the partial piece of the holding arm that is directed in the direction of the torsion portion merges with the angled end portion of said holding arm, are such that the holding arm is supported, in the assembly position, in a region of a transition point at a face of the rib that is associated with the rail to be fastened.

9. The system according to claim 5, wherein, in the assembly position, the torsion portion runs parallel to the rib, without resting against said rib.

10. The system according to claim 1, wherein the tensioning clamp is ω-shaped in its configuration, wherein the central portion is shaped in a looped manner and there issues therefrom the two torsion portions which are oriented counter to each other and to which the respective holding arm having the angled end portion is connected via the respective transition portion.

11. The system according to claim 1, wherein the torsion portion of the tensioning clamp is supported, in the assembly position, on the carrying plate.

* * * * *

UNITED STATES PATENT AND TRADEMARK OFFICE

CERTIFICATE OF CORRECTION

PATENT NO. : 8,408,477 B2
APPLICATION NO. : 12/680373
DATED : April 2, 2013
INVENTOR(S) : Winfried Böesterling It is certified that error appears in the above-identified patent and that said Letters Patent is hereby corrected as shown below:

On the Title Page of the Patent, Item (86) §371(c)(1),(2),(4) Date, Line 1, delete "Mar. 26, 2010" and insert -- May 05, 2010 --

In the Claims:

Column 6, Line 54, Claim 1, after "arm" delete "which is"

Signed and Sealed this
Second Day of July, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 8,408,477 B2
APPLICATION NO. : 12/680373
DATED : April 2, 2013
INVENTOR(S) : Winfried Bösterling It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 257 days.

Signed and Sealed this
First Day of September, 2015

Michelle K. Lee

Michelle K. Lee
*Director of the United States Patent and Trademark Office*